US008774652B2

(12) United States Patent
Nakao

(10) Patent No.: US 8,774,652 B2
(45) Date of Patent: Jul. 8, 2014

(54) IMAGE FORMING APPARATUS, IMAGE FORMING METHOD, AND IMAGE FORMING PROGRAM

(75) Inventor: Kenta Nakao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 13/326,609

(22) Filed: Dec. 15, 2011

(65) Prior Publication Data

US 2012/0163840 A1 Jun. 28, 2012

(30) Foreign Application Priority Data

Dec. 24, 2010 (JP) ..... 2010-287196

(51) Int. Cl.
*G03G 15/01* (2006.01)

(52) U.S. Cl.
USPC ..... 399/39

(58) Field of Classification Search
CPC ..... G03G 15/0121; G03G 15/0824; G03G 15/0829; G03G 2215/00042
USPC ..... 399/39, 40, 41, 296
See application file for complete search history.

(56) References Cited

U.S. PATENT DOCUMENTS

2011/0103811 A1* 5/2011 Tamaki ..... 399/40

FOREIGN PATENT DOCUMENTS

| | | | |
|---|---|---|---|
| JP | 5-265287 | A | 10/1993 |
| JP | 2007-049488 | A | 2/2007 |
| JP | 2008-129547 | A | 6/2008 |

* cited by examiner

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

An image forming apparatus that applies clear toner to an image to be formed based on image data being input and image information regarding the image data when forming the image, the image forming apparatus including a subject detection unit that detects a subject included in the image data based on the image information, the subject including plural pixels; and a setting unit that sets a first maximum value for amounts of the clear toner, each amount being an amount of the clear toner to be applied to a corresponding pixel included in the subject, based on a detection result of the subject.

12 Claims, 12 Drawing Sheets

FIG.8

| SPACING OF PHTOGRAPHIC SUBJECTS | REFERENCE TOTAL AMOUNT VALUE $\alpha$ BASE |
|---|---|
| S=0 | 100 |
| S=1 | 80 |
| S=2 | 60 |
| S=3 | 40 |
| S=4 | 20 |

80

FIG.9

| BRIGHTNESS DIFFERENCE | REFERENCE TOTAL AMOUNT VALUE $\alpha$ BASE |
|---|---|
| G=0 | 120 |
| G=1 | 100 |
| G=2 | 80 |
| G=3 | 60 |
| G=4 | 40 |

81

IMAGE FORMING APPARATUS, IMAGE FORMING METHOD, AND IMAGE FORMING PROGRAM

BACKGROUND OF THE INVENTION

1. Field of the Invention

Embodiments of the present invention relate to an image forming apparatus which applies a clear toner when forming an image based on image data being input and image information about the image data, an image forming method using the image forming apparatus, and an image forming program that is executed in the image forming apparatus.

2. Description of the Related Art

Recently, as an electro-photographic technique, there is a technique to enhance glossiness of an image which is fixed. In the technique, a clear toner image is superimposed onto a color toner image including a yellow image, a magenta image, a cyan image, and a black image, so that the surface becomes even.

For example, Patent Document 1 (Japanese Published Unexamined Publication No. Hei 05-265287) discloses an image forming technique using clear toner. In the image forming technique, glossiness of an output image is controlled by regulating an amount of the clear toner depending on whether the clear toner is applied to a photographic area or a text area in a document.

However, in a conventional image forming apparatus described above, when changing an amount of the clear toner to be applied only to a predetermined area, a user may be required to designate the area. Thus an operation is complicated. Further, when the user does not designate the area, a constant amount of the clear toner is applied to the whole area of a recording paper, on which an output image is to be printed. Therefore, more of the clear toner may be consumed than required.

Embodiments of the present invention have been developed in view of the above situation. Objectives of the embodiments are to provide an image forming apparatus, an image forming method, and an image forming program that can vary an amount of clear toner to be applied to a predetermined area without user designation, and that can reduce consumption of the clear toner.

SUMMARY OF THE INVENTION

In one aspect, there is provided an image forming apparatus that applies clear toner to an image to be formed based on image data being input and image information regarding the image data when forming the image, the image forming apparatus including a subject detection unit that detects a subject included in the image data based on the image information, the subject including plural pixels; and a setting unit that sets a first maximum value for amounts of the clear toner, each amount being an amount to be applied to a corresponding pixel included in the subject, based on a detection result of the subject.

In another aspect, there is provided a method of forming an image using an image forming apparatus, the image forming apparatus applying clear toner to an image to be formed based on image data being input and image information regarding the image data when forming the image, the method including a subject detecting step for detecting a subject included in the image data based on the image information, the subject including plural pixels; and a setting step for setting a first maximum value for amounts of the clear toner, each amount being an amount the clear toner to be applied to a corresponding pixel included in the subject, based on a detection result of the subject.

In another aspect, there is provided a non-transitory recording medium storing a program thereon which causes an image forming apparatus, the image forming apparatus applying clear toner to an image to be formed based on image data being input and image information regarding the image data when forming the image, to perform an image forming process, the image forming process including a subject detecting step for detecting a subject included in the image data based on the image information, the subject including plural pixels; and a setting step for setting a first maximum value for amounts of the clear toner, each amount being an amount of the clear toner to be applied to a corresponding pixel included in the subject, based on a detection result of the subject.

Other objects, features and advantages of the present invention will become more apparent from the following detailed description when read in conjunction with the accompanying drawings.

BRIEF DESCRIPTION OF THE DRAWINGS

FIG. 8 is a diagram illustrating an example of a table in which various types of photographic subjects and reference total amount values are associated;

FIG. 9 is a diagram showing an example of a table in which brightness differences and the reference total amount values are associated;

DETAILED DESCRIPTION OF THE PREFERRED EMBODIMENTS

In embodiments described below, a reference value for an amount of clear toner which is applied to pixels of a photographic subject is set. Here, the photographic subject is detected in image data. The amount of the clear toner applied to each pixel is determined based on the reference value.

First Embodiment

Figure 1:
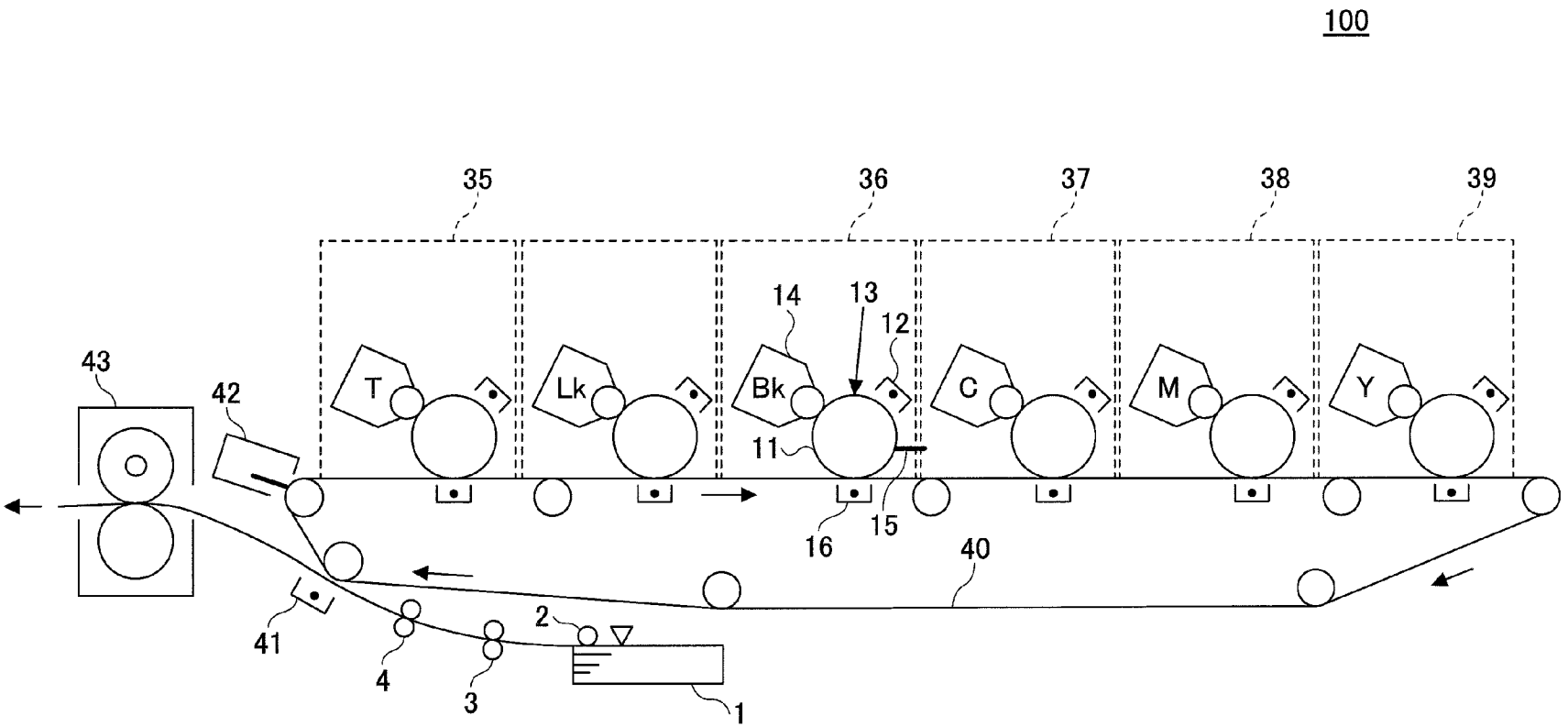
FIG. 1 is a diagram illustrating a schematic configuration of an image forming apparatus according to a first embodiment.

Hereinafter, a first embodiment is explained with reference to figures. FIG. 1 is a diagram illustrating a schematic configuration of an image forming apparatus according to the first embodiment.

In the image forming apparatus 100 according to the first embodiment, recording paper 1 is separated and fed one by one and conveyed toward a pair of conveyance rollers 3 by a paper feeding roller 2. The pair of conveyance rollers 3 further conveys the recording paper 1 to a pair of registration rollers 4. Rotations of the pair of registration rollers 4 are controlled by a registration clutch not shown in the figure. The registration clutch causes the pair of registration rollers 4 to rotate or to stop. The image forming apparatus 100 causes the recording paper 1 to stop once at the pair of registration rollers 4 so as to wait for termination of a sequence of image forming processes, which are described below.

An image forming station 36 (for forming black images) is surrounded by a dashed line. An electrostatic charger 12, an exposing beam 13, a developing device 14, a cleaning blade 15, and a primary transfer charger 16 are arranged around a circumference of a photosensitive body 11. The image forming station performs a sequence of image forming operations.

The exposing beam 13 that comes from a writing unit (not shown in the figure), is irradiated on a surface of the photosensitive body 11 which is uniformly charged by the electrostatic charger 12, and a latent image is formed on the photosensitive body 11. At the developing device 14, the latent image is developed with black toner. The latent image is visualized as a toner image. Then the toner image is transferred onto an intermediate transfer belt 40 by the primary transfer charger 16. The toner residing on the photosensitive body 11 is removed by the cleaning blade 15. Subsequently, the photosensitive body 11 is charged again by the electrostatic charger 12. After that, the above described image forming operations are repeated.

Image forming stations 37, 38, and 39 (for forming cyan images, magenta images, and yellow images, respectively) are also surrounded by dashed lines. The image forming stations 37, 38, 39 transfer a cyan toner image, a magenta toner image, and an yellow toner image onto the intermediate transfer belt 40 through operations similar to the operation for the black toner image. Further, an image forming station 35 (for forming clear images) is surrounded by a dashed line. Operations of the image forming station for forming clear images are the same as that of the other image forming stations.

After transferring the black toner image, the cyan toner image, the magenta toner image, and the clear toner image onto the intermediate transfer belt 40, the image forming apparatus 100 resumes conveying the recording paper 1 stopped at the pair of registration rollers 4. Then the image forming apparatus 100 transfers the toner images onto the recording paper with a secondary transfer charger 41. Subsequently, the recording paper 1 is conveyed to a fixing device 43. The pre-fixed toner is fixed by heat and pressure at the fixing device 43. After that, the image forming apparatus 100 outputs the recording paper 1.

The toner residing on the intermediate transfer belt 40 is removed by pressing an intermediate transfer cleaner 42 against the intermediate transfer belt. In the first embodiment, the clear toner is placed on the lowermost layer of the toner on the intermediate transfer belt 40 (the layer adjacent to the intermediate transfer belt 40). Therefore, in the image forming apparatus 100 according to the first embodiment, when the toner images are transferred onto the recording paper 1, the toner images other than the clear toner image rarely reside on the intermediate transfer belt 40. Thus an image can be formed to have a good color reproduction range.

Figure 2:
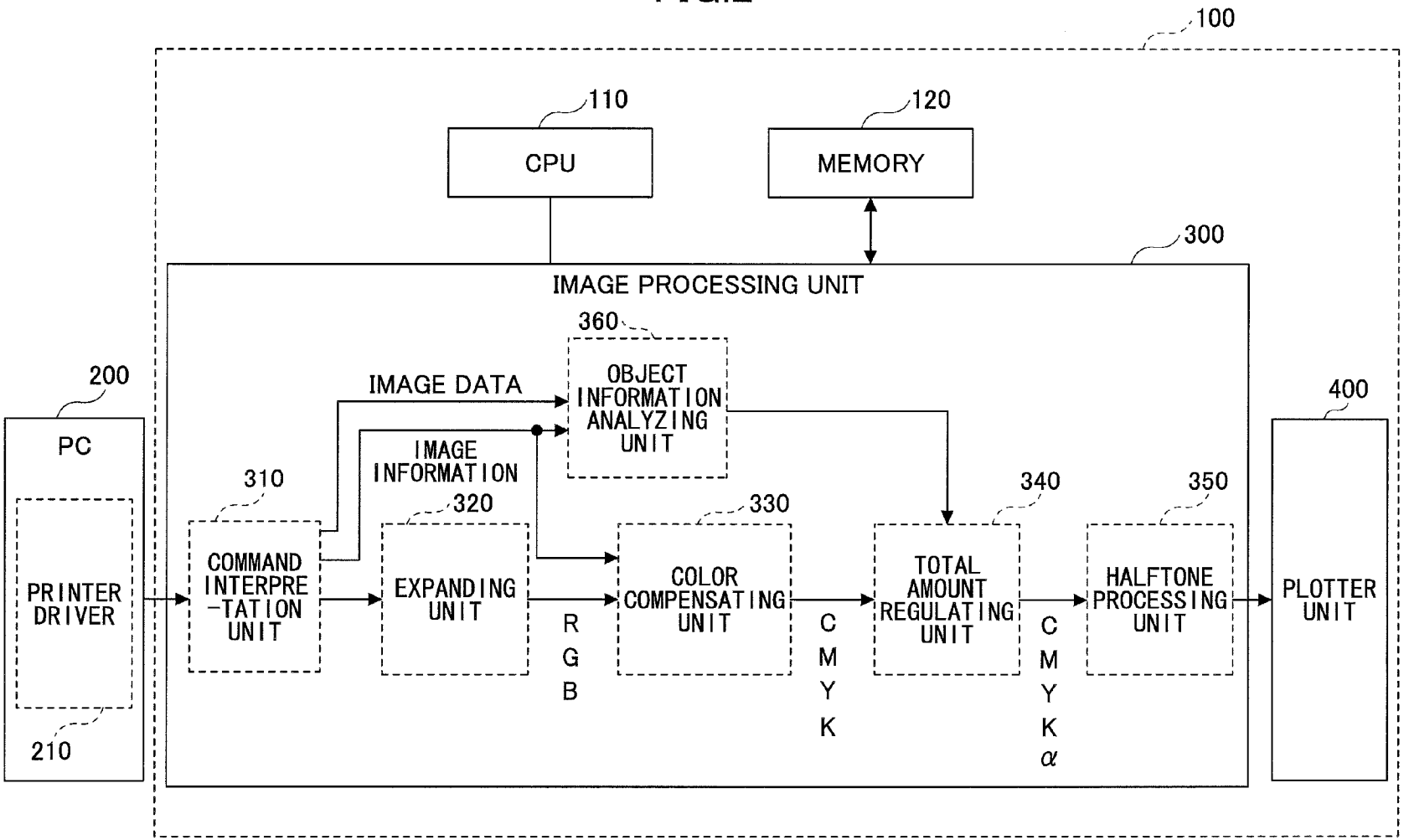
FIG. 2 is a diagram illustrating a functional configuration of the image forming apparatus according to the first embodiment.

Next, a functional configuration of the image forming apparatus 100 according to the first embodiment is explained by referring to FIG. 2. FIG. 2 is a diagram illustrating the functional configuration of the image forming apparatus 100 according to the first embodiment.

The image forming apparatus 100 according to the first embodiment is connected to a computer 200, for example, through a network. When the computer 200 outputs a printer command described in a printer description language (PDL) with image data through a printer driver 210, the image forming apparatus 100 performs image processing in response to the printer command.

The image forming apparatus 100 according to the first embodiment includes a central processing unit (CPU) 110, memory 120, an image processing unit 300, and a plotter unit 400.

The CPU 110 is responsible for overall control of the image forming apparatus 100. The memory 120 stores data or setting values which may be necessary for processing of the image forming apparatus 100. The image processing unit 300 applies image processing to the image data transmitted from the computer 200. The plotter unit 400 prints the image data, to which the image processing is applied, with the image processing unit 300 onto the recording papers and outputs the recording papers.

Hereinafter, the image processing unit 300 according to the first embodiment is explained in detail.

The image processing unit 300 according to the first embodiment includes a command interpretation unit 310, an expanding unit 320, a color compensating unit 330, a total amount regulating unit 340, a halftone processing unit 350, and an object information analyzing unit 360.

When the image data transmitted from the computer 200 is graphic data, the image processing unit 300 performs a specific process.

Specifically, when the image data is graphic data, the image processing unit 300 according to the first embodiment detects a photographic subject included in the image data and applies the clear toner to the photographic subject. In addition, the image processing unit 300 changes an amount of the clear toner applied to the photographic subject depending on the photographic subject.

The image processing unit 300 according to the first embodiment determines whether the image data transmitted from the computer 200 is graphic data or not using the command interpretation unit 310.

When the image data is graphic data, the image processing unit 300 detects the photographic subject in the image data using the object information analyzing unit 360, and the image processing unit 300 performs a process to define a maximum value for amounts of the clear toner, each amount being an amount applied to a corresponding pixel included in an area of the photographic subject in the image data. Then the image processing unit 300 determines amounts of the clear toner applied to the corresponding pixels based on the defined maximum value using the total amount regulating unit 340. In the following explanation of the first embodiment, a maximum value of the amounts of the clear toner, each amount being the amount applied to the corresponding pixel, is called a reference total amount value. Details of the reference total amount value are explained later.

Additionally, when the image data is not graphic data, the image processing unit 300 according to the first embodiment performs conventional image processing using the expanding unit 320, the color compensating unit 330, the total amount regulating unit 340, and the halftone processing unit 350.

Hereinafter, each unit included in the image processing unit 300 is further explained.

The command interpretation unit 310 analyzes the printer command transmitted from the computer 200 and interprets the content of the printer command. Data output from the computer 200 to the image forming apparatus 100 includes the printer command, the image data, and image information. The printer command includes draw commands for three types of objects. The three types of objects are character objects, graphic objects, and image objects. The image data is produced by, for example, an application on the computer 200, and the image data is data to be output.

The image information is information about various items regarding the image data including, for example, format information of the image data. It is preferable that the image information according to the first embodiment includes, for example, information about items defined in Exchangeable Image File Format (Exif) a standard for digital still cameras. Hereinafter, in the explanation of the first embodiment, information about the items defined for digital still cameras is referred to as Exif information.

The Exif information includes object information for each object included in the image. The object information includes the size of the object, the position of the object in the image, the area of the object, and the brightness of the object. In the first embodiment, a specific object included in the image is detected as the photographic subject.

When the command interpretation unit 310, according to the first embodiment, determines, as a result of interpreting the printer command, that the image data is graphic data and the image information includes the Exif information, as a result of interpreting the printer command, the command interpretation unit 310 passes the image data and the image information to the object information analyzing unit 360. Further, the command interpretation unit 310 passes the image information to the color compensating unit 330.

Further, when the command interpretation unit 310 determines, as a result of interpreting the printer command, that the image data is not graphic data or determines that the image information does not include Exif information, the command interpretation unit 310 passes the image data to the expanding unit 320.

The expanding unit 320 expands the image as Red-Green-Blue Color Model (RGB) data on the memory 120. The color compensating unit 330 converts the RGB data expanded on the memory 120 into CMYK data and passes the Cyan-Magenta-Yellow-Key Color Model (CMYK) data to the total amount regulating unit 340. The CMYK data is data for forming a C toner image to be formed with the cyan toner, an M toner image to be formed with the magenta toner, a Y toner image to be formed with the yellow toner, and a K toner image to be formed with the black toner. The CMYK data is expressed by plural dots. Each dot has a tone value. Here, the tone value takes a value between 0 (white) and 255 (black). Hereinafter, in the explanation of the first embodiment, an image in a state in which the C toner image, the M toner image, the Y toner image, and the K toner image being formed from the CMYK data are superimposed is referred to as a process toner image.

When the image data is not graphic data, the total amount regulating unit 340 regulates the amounts of the C toner, the M toner, the Y toner, and the K toner to be applied to form the process toner image. In addition, the total amount regulating unit 340 regulates the amount of the clear toner to be applied.

Further, when the image data is graphic data, and, the total amount regulating unit 340 regulates a total amount of the clear toner to be applied based on the reference total amount value, which is input from the object information analyzing unit 360. Details of the total amount regulation based on the reference total amount value are explained later.

Values indicating the amounts of the C toner, the M toner, the Y toner, the K toner, and the clear toner to be applied are output from the total amount regulating unit 340 and input to the halftone processing unit 350. Here the amounts of the C toner, the M toner, the Y toner, the K toner, and the clear toner are regulated by the total amount regulating unit 340.

The halftone processing unit 350 performs a halftone process, such as dithering or an error diffusion process, based on the amounts of the C toner, the M toner, the Y toner, the K toner, and the clear toner, which are output from the total amount regulating unit 340, and generates the CMYK data and clear toner data. The CMYK data output from the halftone processing unit 350 is data for forming the process toner image with the C toner, the M toner, the Y toner, and the K toner. Here, the amounts of the C toner, the M toner, the Y toner, and the K toner to be applied are regulated. Further, the clear toner data output from the halftone processing unit 350 is data for forming image with the clear toner. Here, the amount of the clear toner to be applied is regulated.

The halftone processing unit 350 transmits ON/OFF information of dots for the C toner image, the M toner image, the Y toner image, the K toner image, and the clear toner image to the plotter unit 400. The plotter unit 400 forms the image in accordance with the CMYK data and the clear toner data, which are output from the halftone processing unit 350.

When the object information analyzing unit 360 receives the image data and the image information, the object analyzing unit 360 defines the reference total amount value αBase of the clear toner depending on the type of the photographic subject detected in the image data, and outputs the defined reference total amount value αBase to the total amount regulating unit 340. Details of the object information analyzing unit 360 are explained later.

Figure 3:
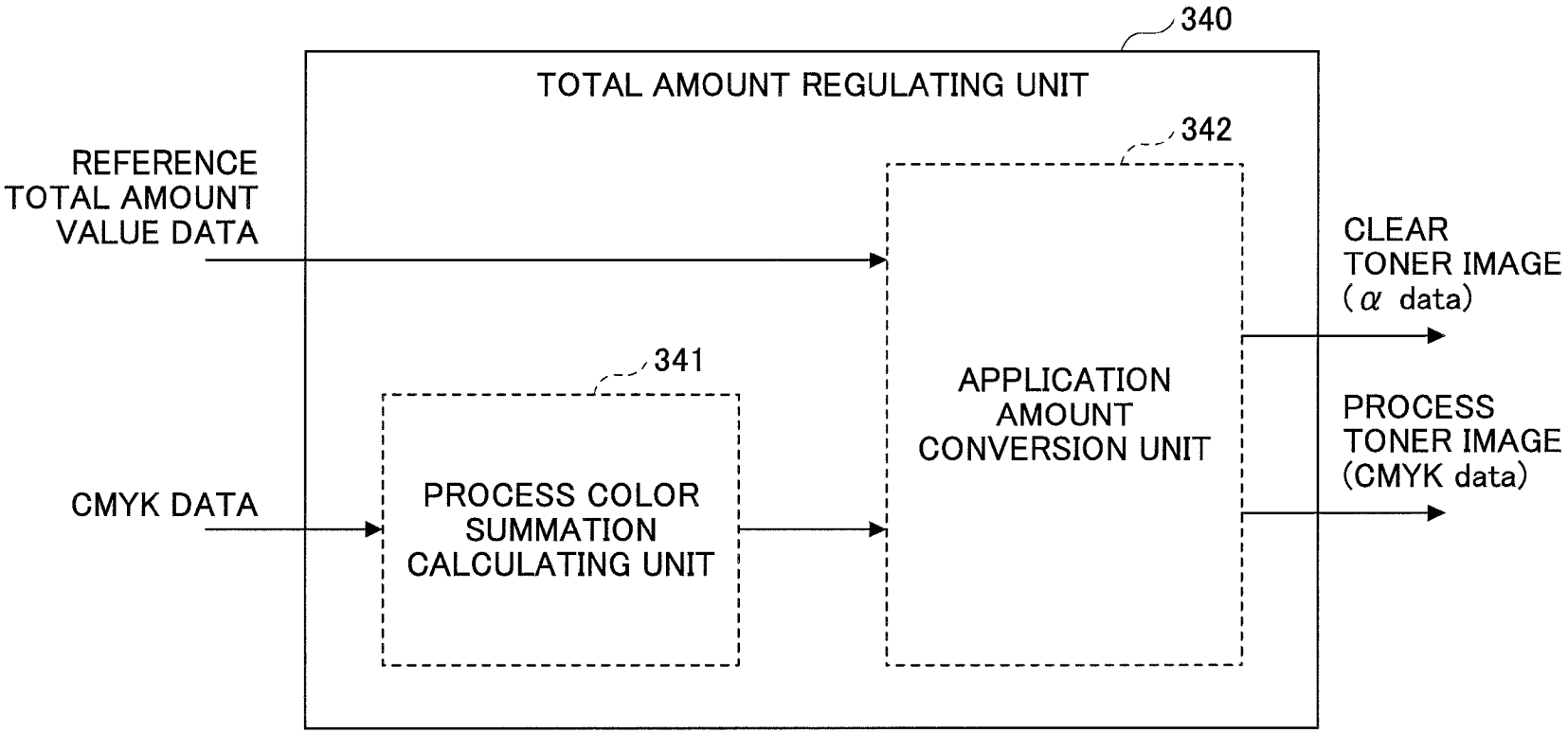
FIG. 3 is a diagram illustrating a total amount regulating unit of the first embodiment.

Next, the total amount regulating unit 340 of the first embodiment is explained by referring to FIG. 3. FIG. 3 is a diagram illustrating the total amount regulating unit 340 of the first embodiment.

The total amount regulating unit 340 of the first embodiment includes a process color summation calculating unit 341 and an application amount conversion unit 342.

The process color summation calculating unit 341 calculates a summation of the amounts of the C toner, the M toner, the Y toner, and the K toner to be applied for forming the process toner image. Then the process color summation calculating unit 341 outputs the summation to the application amount conversion unit 342. Here, the summation of the amounts of the C toner, the M toner, the Y toner, and the K toner to be applied is the summation to be applied to one pixel in the image data.

Hereinafter, in the explanation of the first embodiment, the summation of the amounts of the C toner, the M toner, the Y toner, and the K toner to be applied for forming the process toner image is referred to as a process toner amount.

The application amount conversion unit 342 calculates a process toner summation amount regulating value, which is a regulated value of the process toner amount, and a clear toner summation amount regulating value, which is a regulated value of the reference total amount value αBase.

Specifically, the application amount conversion unit 342 calculates the process toner summation amount regulating value with a formula (1) below. Further, the application amount conversion unit 342 calculates the clear toner summation amount regulating value with a formula (2) below. The process toner summation amount regulating value and the clear toner summation amount regulating value calculated by the application amount conversion unit 342 are output to the halftone processing unit 350.

[EXPRESSION 1]

$$\text{if}((C+M+Y+K)>\text{MAX1})$$

$$C'=C\times(\text{MAX1}\times255/100-K)/(C+M+Y)$$

$$M'=M\times(\text{MAX1}\times255/100-K)/(C+M+Y)$$

$$Y'=Y\times(\text{MAX1}\times255/100-K)/(C+M+Y)$$

$$\text{else}$$

$$C'=C$$

$$M'=M$$

$$Y'=Y \qquad \text{Formula (1)}$$

Here, MAX 1 is the process toner summation amount regulating value. The process toner summation amount regulating value MAX1 of the first embodiment is set such that, when a sum total regulating value, which is a total value of the process toner summation amount regulating value and the clear toner summation amount regulating value, is defined to be MAX2, the sum total regulating value MAX2 is greater than or equal to the process toner summation amount regulating value MAX1.

Further, C, M, Y, and K are the amounts of the C toner, the M toner, the Y toner, and the K toner to be applied to each pixel prior to the amounts being regulated. Further, C', M', and Y' are the amounts of the C toner, the M toner, and the Y toner to be applied to each pixel after the amounts are regulated. The amount of the K toner to be applied is not changed by the total amount regulation. Therefore, the process toner summation amount regulation value is C'+M'+Y'+K.

[EXPRESSION 2]

$$\text{if}((C'+M'+Y'+K)>\alpha\text{Base})$$

$$\alpha=0$$

$$\text{else}$$

$$\alpha=\alpha\text{Base}-(C'+M'+Y'+K) \qquad \text{Formula (2)}$$

Figure 4:
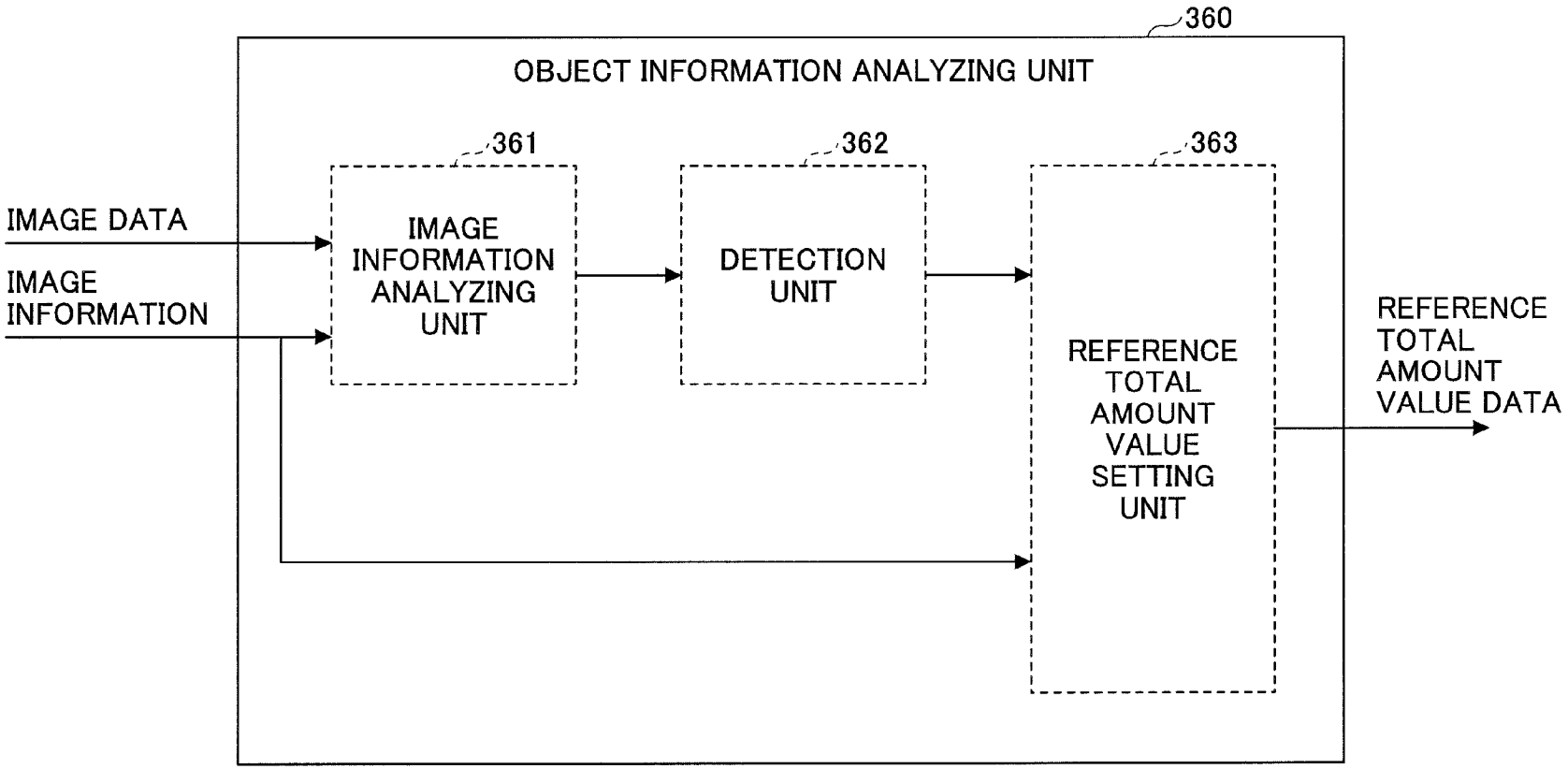
FIG. 4 is a diagram illustrating details of an object information analyzing unit.

Next, the object information analyzing unit 360 of the first embodiment is explained by referring to FIG. 4. FIG. 4 is a diagram illustrating the details of the object information analyzing unit.

The object information analyzing unit 360 of the first embodiment includes an image information analyzing unit 361, a detection unit 362, and a reference total amount value setting unit 363. The image information analyzing unit 361 of the first embodiment analyzes the image information. The detection unit 362 detects the photographic subject from the image data based on an analyzing result of the image information. Details of the image information analyzing unit 361 and the detection unit 362 are explained later. The reference total amount value setting unit 363 sets the reference total amount value of the clear toner αBase based on the type or the size of the photographic subject detected by the detection unit 362.

Hereinafter, the reference total amount value of the clear toner αBase is explained by referring to FIGS. 5A, 5B, 5C, and FIGS. 6A, 6B, 6C.

Figure 5A:
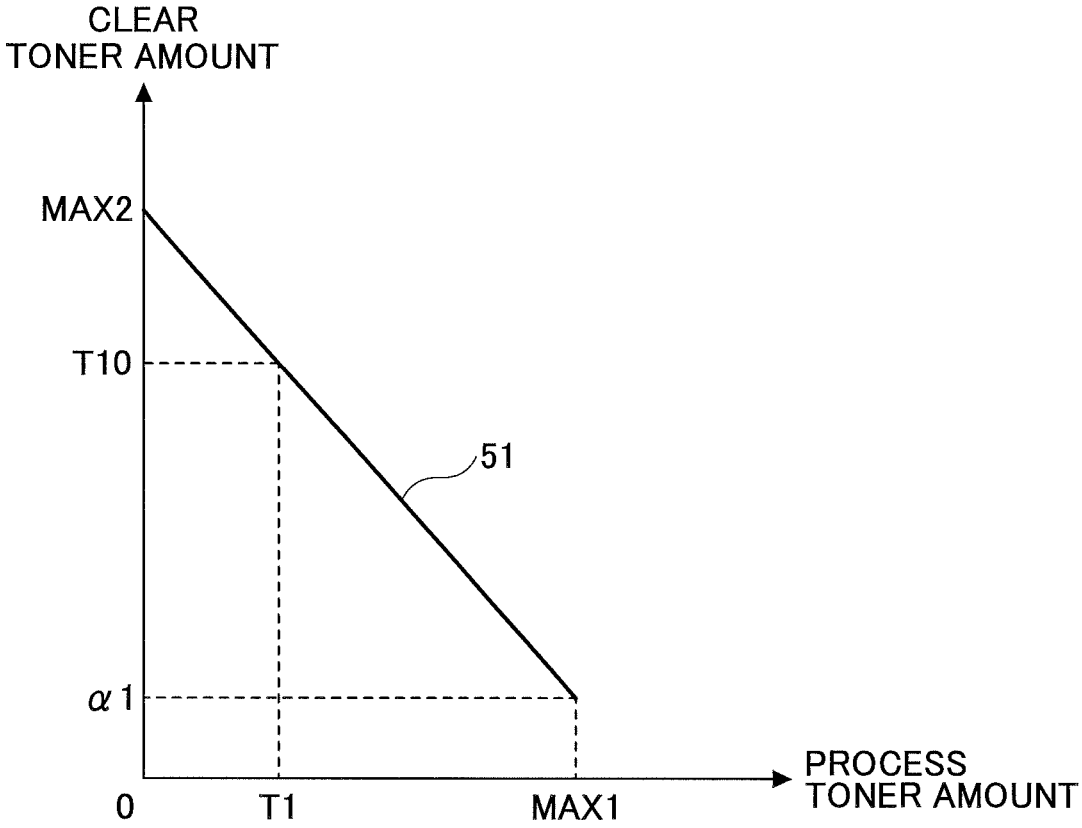
FIGS. 5A, 5B, and 5C are first diagrams illustrating a reference total amount value of clear toner.
Figure 5B:
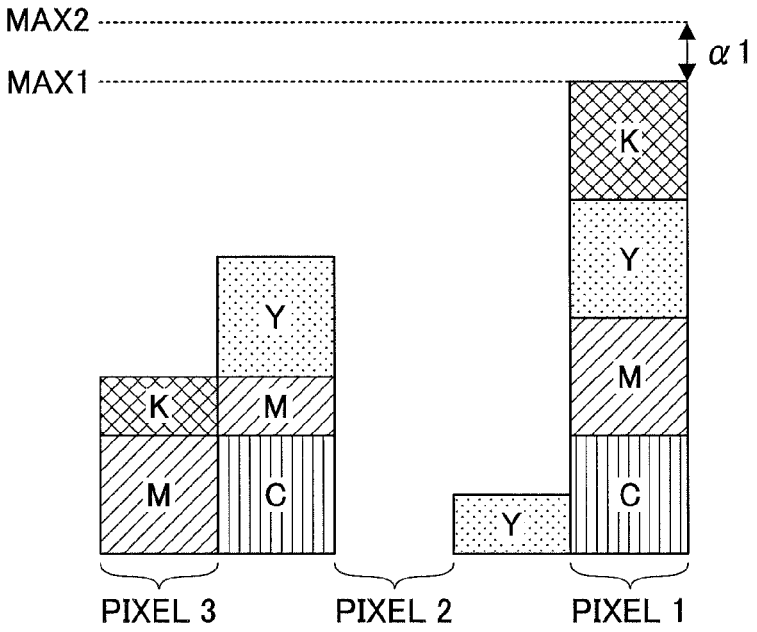
Figure 5C:
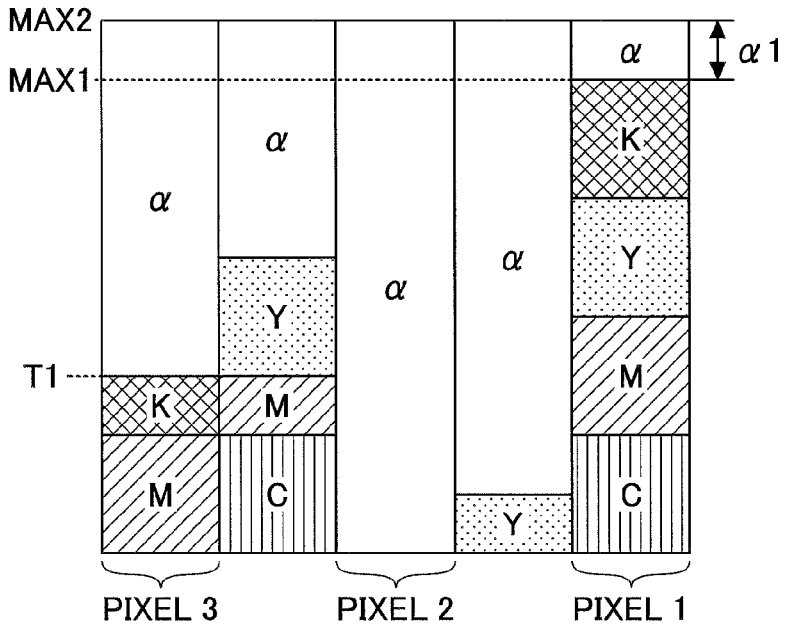

FIGS. 5A, 5B, and 5C are first diagrams illustrating the reference total amount value of the clear toner. An example in FIGS. 5A, 5B, and 5C shows a state in which the reference total amount value αBase is not defined. FIG. 5A is a diagram showing a relationship between the process toner amount for forming the process toner image and a clear toner amount for forming the clear toner image. FIG. 5B is a conceptual diagram of a cross section of the recording paper prior to the clear toner being applied to the recording paper. FIG. 5C is a conceptual diagram of the cross section of the recording paper when the clear toner has been applied to the recording paper.

When the relationship between the process toner amount and the clear toner amount is represented by a function 51 connecting a point (0, MAX2) and another point (MAX1, α1), as shown in FIG. 5A, the clear toner α are applied to each pixel, as shown in FIG. 5C.

For example, for a pixel 1 in FIG. 5C, a value of the process toner amount is the process toner summation amount regulating value MAX1. Therefore, according to the function 51, an amount of the clear toner α applied to the pixel 1 is α1. Further, for a pixel 2, a value of the process toner amount is zero. Therefore, according to the function 51, an amount of the clear toner α applied to the pixel 2 is the sum total regulating value MAX2. Further, for a pixel 3, a value of the process toner amount is T1. Therefore, according to the function 51, an amount of the clear toner α applied to the pixel 3 is T10.

Namely, in the example of FIGS. 5A, 5B, and 5C, the amount of the clear toner applied to each pixel is greater than or equal to α1.

Figure 6A:
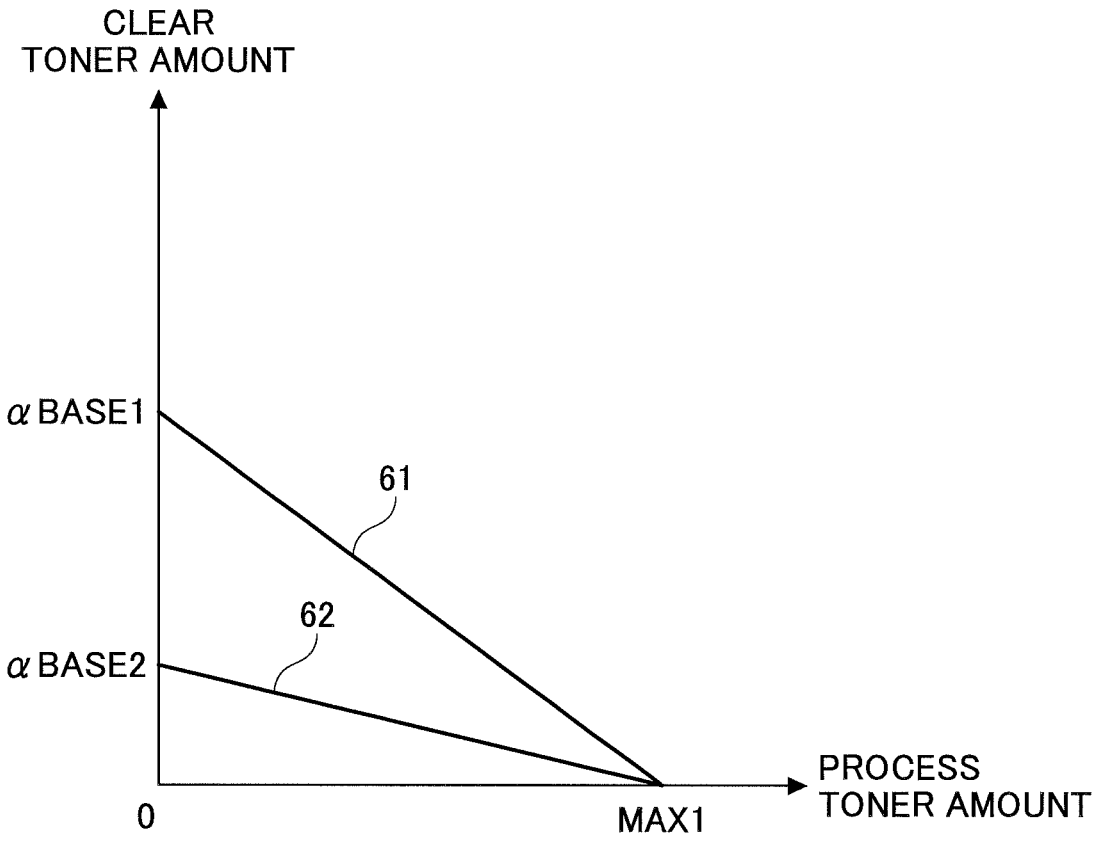
FIGS. 6A, 6B, and 6C are second diagrams illustrating the reference total amount value of the clear toner.
Figure 6B:
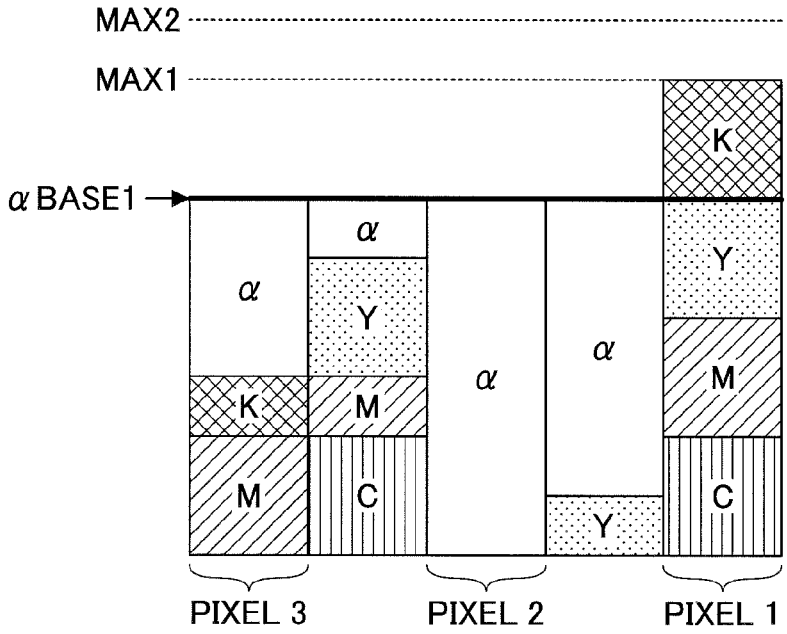
Figure 6C:
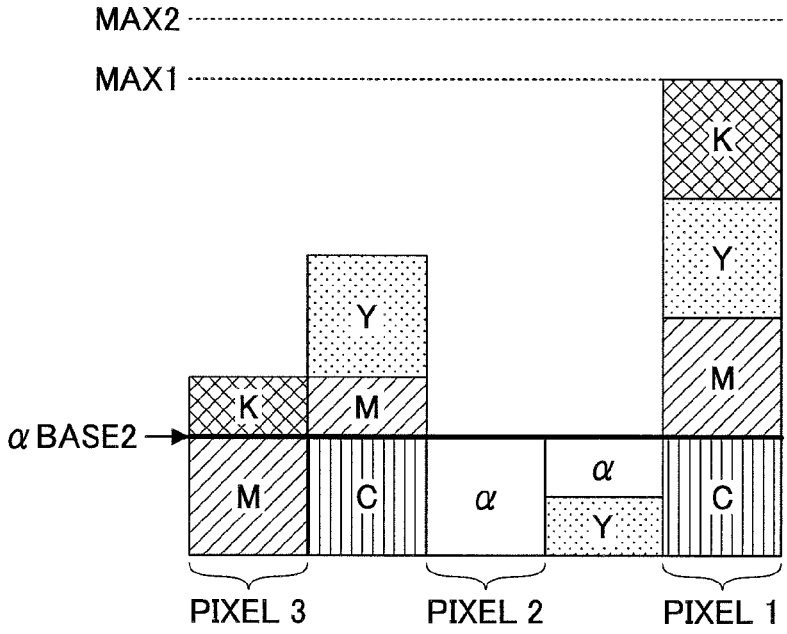

In contrast to the example of FIGS. 5A, 5B, and 5C, a case in which the reference total amount value αBase is defined is explained by referring to FIGS. 6A, 6B, and 6C. FIGS. 6A, 6B, and 6C are second diagrams illustrating the reference total amount value of the clear toner. Examples of FIGS. 6A, 6B, and 6C show states in which the reference total amount value αBase is defined. FIG. 6A is a diagram showing a relationship between the process toner amount for forming the process toner image and a clear toner amount for forming the clear toner image. FIG. 6B is a conceptual diagram of a cross section of the recording paper prior to the clear toner being applied to the recording paper. FIG. 6C is a conceptual diagram of the cross section of the recording paper when the clear toner have been applied to the recording paper.

In the examples, the reference total amount value αBase is defined to be a value less than or equal to the process toner summation amount regulating value MAX1. In FIG. 6A, when the reference total amount value is defined to be αBase1, the relationship between the process toner amount and the clear toner amount is represented by a function 61. Further, in FIG. 6A, when the reference total amount value is defined to be αBase2, the relationship between the process toner amount and the clear toner amount is represented by a function 62.

FIG. 6B shows a case in which the reference total amount value is αBase1. FIG. 6C shows a case in which the reference total amount value is αBase2. In the examples, the clear toner is applied to a pixel by an amount corresponding to a difference between the reference total amount value αBase and the process toner amount, only if, for the pixel, the value of process toner amount is less than the reference total amount αBase.

In FIG. 6B, for example, the clear toner is not applied to a pixel 1, since the process toner amount is greater than the reference total amount value αBase1. Further, for a pixel 2, since the process toner amount is zero, the amount of the clear toner to be applied is the reference total amount value αBase1. Further, for a pixel 3, since the process toner amount is less than the reference total amount value αBase1, the amount of the clear toner to be applied to the pixel 3 is a clear toner amount corresponding to the process toner amount for the pixel 3 in the function 61.

Similarly, in FIG. 6C, since the process toner amounts are greater than the reference total amount value αBase2 for pixels 1 and 3, the clear toner is not applied to the pixels 1 and 3. For a pixel 2, since the process toner amount is zero, the amount of the clear toner to be applied is the reference total amount value αBase2.

In this manner, when the reference total amount value αBase is defined for the clear toner, applying clear toners to the whole of the image data can be avoided. Therefore, the consumption of the clear toner can be reduced.

Additionally, as candidates for the reference total amount value αBase of the first embodiment, plural types of values are stored in the memory 120 in advance. Then, one of the plural types of values is set to be the reference total amount value αBase by the reference total amount value setting unit 363, based on a detection result of the photographic subject detected by the detection unit 362.

Hereinafter, processes performed by the image information analyzing unit 361 and processes performed by the detection unit 362 of the first embodiment are explained.

The image information analyzing unit 361 of the first embodiment analyzes the image information, which is input to the object information analyzing unit 360 together with the image data. Specifically, the image information analyzing unit 361 analyzes the image information and extracts object information of the objects included in the image. When plural objects are extracted in the image information, the image information analyzing unit 361 extracts a spacing of the objects. The image information analyzing unit 361 of the first embodiment outputs the extracted analyzing result to the detection unit 362.

The detection unit 362 of the first embodiment detects the photographic subject based on the analyzing result and selects the reference total amount value αBase of the clear toner to be applied to the photographic subject based on the detection result. The detection unit 362 notifies the reference total amount value setting unit 363 of the selected reference total amount value αBase. The reference total amount value setting unit 363 sets the selected reference total amount value αBase in the total amount regulating unit 340.

Figure 7:
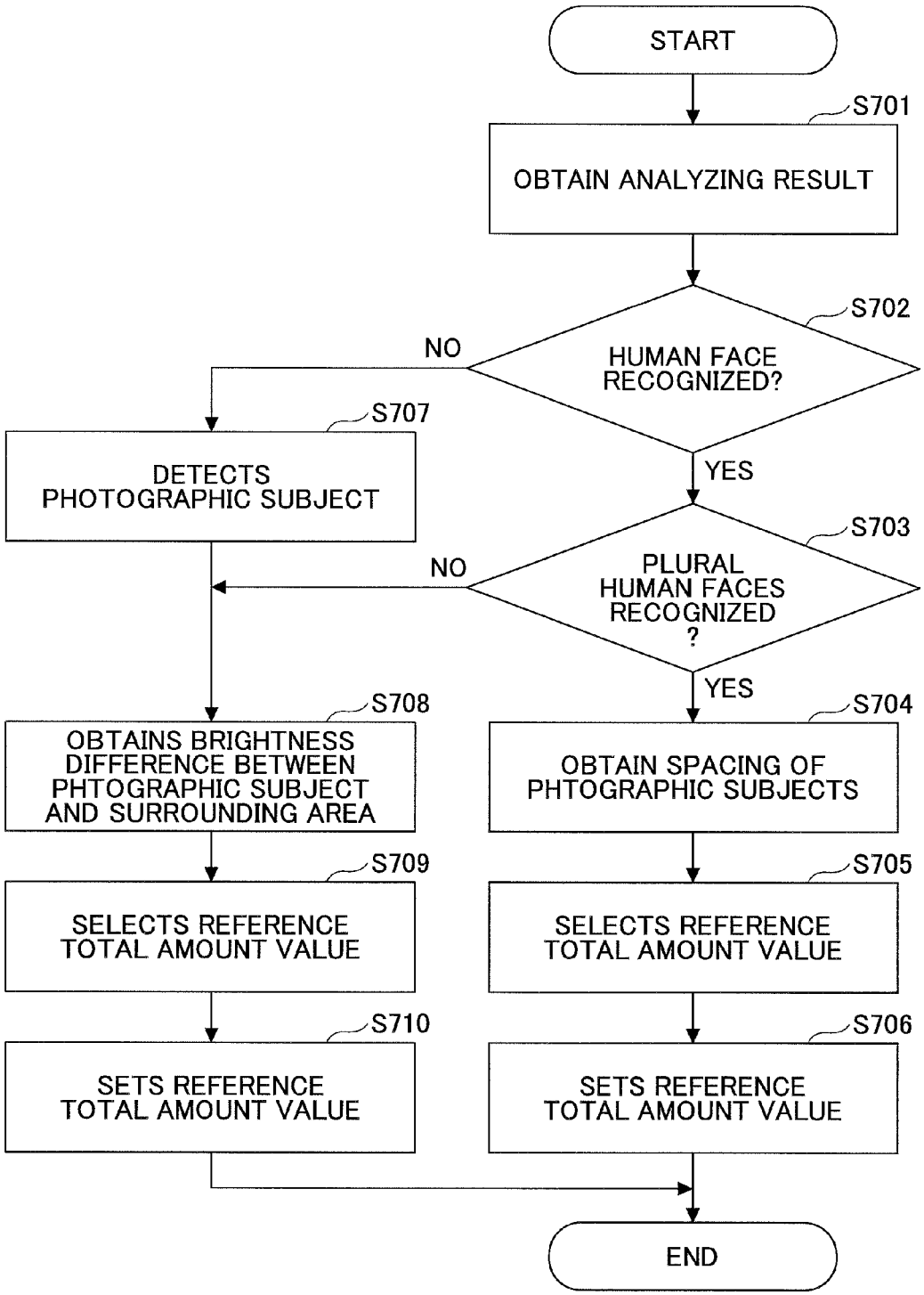
FIG. 7 is a flowchart illustrating processes performed by a detection unit and processes performed by a reference total amount value setting unit of the first embodiment.

Hereinafter, processes performed by the detection unit 362 and processes performed by the reference total amount value setting unit 363 of the first embodiment are explained by referring to FIG. 7. FIG. 7 is a flowchart illustrating the processes performed by the detection unit 362 and the processes performed by the reference total amount value setting unit 363 of the first embodiment.

The detection unit 362 obtains the analyzing result extracted by the image information analyzing unit 361 (step S701). Subsequently, the detection unit 362 determines whether the image data includes a human face, based on the object information included in the analyzing result (step S702). Here, it is preferable that the detection unit 362 includes a face recognition function.

When the human face is recognized at step S702, the detection unit 362 determines whether plural human faces are recognized (step S703). When it is determined that plural human faces are recognized at step S703, the detection unit 362 recognizes the plural human faces as the photographic subjects and obtains a spacing of the objects which have been recognized as the human faces as a spacing of the photographic subjects (S704). Here, when plural human faces are not recognized at step S703, the detection unit 362 proceeds to step S708, which is described later. Subsequently, the detection unit 362 selects the reference total amount value αBase based on the spacing of the photographic subjects (step S705). Here, when three or more human faces are detected, it is preferable to select the reference total amount value αBase based on the shortest distance between two photographic subjects included among the three or more human faces.

Hereinafter, the selection of the reference total amount value αBase is explained. In the first embodiment, the memory 120 stores a table in which various types of spacing of photographic subjects and the reference total amount values αBases are associated. The detection unit 362 selects the reference total amount value αBase corresponding to the detected spacing of the photographic subjects by referring to this table.

FIG. 8 is a diagram illustrating an example of the table in which the various types of spacing of photographic subjects and the reference total amount values αBase are associated. In table 80 of the first embodiment, values indicating the various types of spacing of photographic subjects and the reference total amount values αBases are associated.

In table 80, a case when the distances among the photographic subjects are very short is indicated by S=0, a case when the distances among the photographic subjects are short is indicated by S=1, a case when the distances among the photographic subjects are intermediate is indicated by S=2, a case when the distances among the photographic subjects are long is indicated by S=3, and a case when the distances among the photographic subjects are very long is indicated by S=4. Reference distances may be defined in advance so as to determine that the distances among the photographic subjects are one of very short, short, intermediate, long, and very long. For example, when the distances among the photographic subjects detected by the detection unit 362 are predefined as short distances, the detection unit 362 selects the reference total amount value αBase corresponding to S=1 in the table 80.

In the table 80, when the distances among the photographic subjects are shorter, the reference total amount value αBase is greater. For example, when the process toner summation amount regulating value MAX1 is equal to 100, the reference total amount value αBase corresponding to the case when the distances among the photographic subjects are the very short, which is the case when S=0, is defined to be 100.

In the first embodiment, it is defined that the process toner summation amount regulating value MAX1 is greater than or equal to the reference total amount value αBase. However, the first embodiment is not limited to this example. For example, when the distances among the photographic subjects are very short, the reference total amount value αBase may be defined to be a value greater than the process toner summation amount regulating value MAX1.

Further, in the first embodiment, the example case in which the relationship between the distances among the photographic subjects and the reference total amount value αBase is indicated by the table is explained. However, the first embodiment is not limited to this example. For example, the relationship between the distances among the photographic subjects and the reference total amount value αBase may be expressed by a function representing the relationship. In such a case, a formula of the function is stored in the memory 120.

In the first embodiment, as described above, for the plural photographic subjects placed closer to each other on the image, the reference total amount value αBase is set to be a greater value. With this configuration, the clear toner can be applied to add gloss to the plural photographic subjects placed closer to each other on the image, so that the plural photographic subjects placed closer to each other are highlighted in the entire image.

Referring to FIG. 7 again, when the detection unit 362 selects the reference total amount value αBase at step S705, the detection unit 362 passes the selected reference total amount value αBase to the reference total amount value setting unit 363. Here, the detection unit 362 passes photographic subject area information indicating areas corresponding to the photographic subjects in the image data, in addition to the selected reference total amount value αBase, to the reference total amount value setting unit 363.

The reference total amount value setting unit 363 sets the reference total amount value αBase, which has been passed from the detection unit 362, in the total amount regulating unit 340 (step S706). Further, the reference total amount value setting unit 363 passes the photographic subject area information to the total amount regulating unit 340. The total amount regulating unit 340 regulates the amount of the clear toner applied to the photographic subjects based on the reference total amount value αBase and the photographic subject area information.

Further, when the detection unit 362 does not detect any human face at step S702, the detection unit 362 detects a photographic subject other than a human face (step S707). The detection unit 362 of the first embodiment detects the largest object included in the image data as the photographic subject, based on the size information included in the object information.

Subsequently, the detection unit 362 obtains a brightness difference between the brightness of the detected photographic subject and the brightness of a surrounding area of the photographic subject (step S708). The brightness of the photographic subject is included in the object information. The brightness of the photographic subject may be a value indicating an average value among brightness values of the photographic subject. Further, the brightness of the surrounding area of the photographic subject may be, for example, an average value of brightness values of selected plural points. Here, each of the selected plural points is separated from an outline of the photographic subject by a predetermined distance.

When the detection unit 362 obtains the brightness difference, the detection unit selects the reference total amount value αBase, based on the brightness difference (step S709). In the first embodiment, the memory 120 stores a table in which brightness differences and the reference total amount values αBases are associated. The detection unit 362 selects the reference total amount value αBase corresponding to the brightness difference by referring to the table.

FIG. 9 is a diagram showing an example of the table in which the brightness differences and the reference total amount values are associated. In the table 81 of the first embodiment, values indicating the brightness differences are associated with the corresponding reference total amount values αBases.

In table 81, a case when the brightness difference is very large is indicated by G=0, a case when the brightness difference is large is indicated by G=1, a case when the brightness difference is medium is indicated by G=2, a case when the brightness difference is small is indicated by G=3, and a case when the brightness difference is very small is indicated by G=4. Here, reference values for determining that the brightness difference is one of very large, large, medium, small, and very small may be defined in advance. For example, when the brightness difference detected by the detection unit 362 is a brightness difference whose value is a reference value for determining that the brightness difference is small, the detection unit 362 selects the reference total amount value αBase corresponding to G=3 in table 81. Here, the relationship between the brightness difference and the reference total amount value αBase may be defined by a formula of a function representing the relationship.

Referring to FIG. 7 again, when the detection unit 362 selects the reference total amount value αBase at step S709, the detection unit 362 passes the selected reference total amount value αBase to the reference total amount value setting unit 363. Here, the detection unit 362 passes the photographic subject area information indicating the areas corresponding to the photographic subjects in the image data, in addition to the selected reference total amount value αBase, to the reference total amount value setting unit 363. The reference total amount value setting unit 363 sets the reference total amount value αBase, which has been passed from the detection unit 362, in the total amount regulating unit 340 (step S710).

In the first embodiment, when the detection unit 362 does not detect any human faces, the detection unit 362 detects the largest object among the objects included in the image data as the photographic subject. However, the first embodiment is not limited to this example. For example, in the first embodiment, the detection unit 362 may detect an object placed at a center portion of the image as the photographic object. Further, in the first embodiment, when the detection unit 362 does not detect any human faces, the detection unit 362 selects the reference total amount value αBase, based on the brightness difference. However, the first embodiment is not limited to this example. In the first embodiment, for example, the detection unit 362 may select the reference total amount value αBase using colorfulness or lightness.

As described above, according to the first embodiment, when the image data transmitted from the computer 200 is graphic data, the photographic subject is detected from the image data. After that, the reference total amount value αBase is defined based on the detected photographic subject.

Thus, according to the first embodiment, a constant amount of clear toner applied to the entire image can be avoided. Therefore, consumption of the clear toner is reduced.

Further, in the first embodiment, the photographic subject is detected from the image data and the clear toner is applied to the detected photographic subject. Furthermore, in the first embodiment, the amount of the clear toner applied to the areas corresponding to the photographic subject can be changed without user designation.

Second Embodiment

Hereinafter, the second embodiment is explained with reference to the figures. The second embodiment is different from the first embodiment in a point that the plural reference total amount values αBases may be defined. Therefore, in the explanation of the second embodiment, the same reference numerals are applied to functional configurations which are common to the first embodiment, and the explanations of the common functional configurations are omitted.

Figure 10:
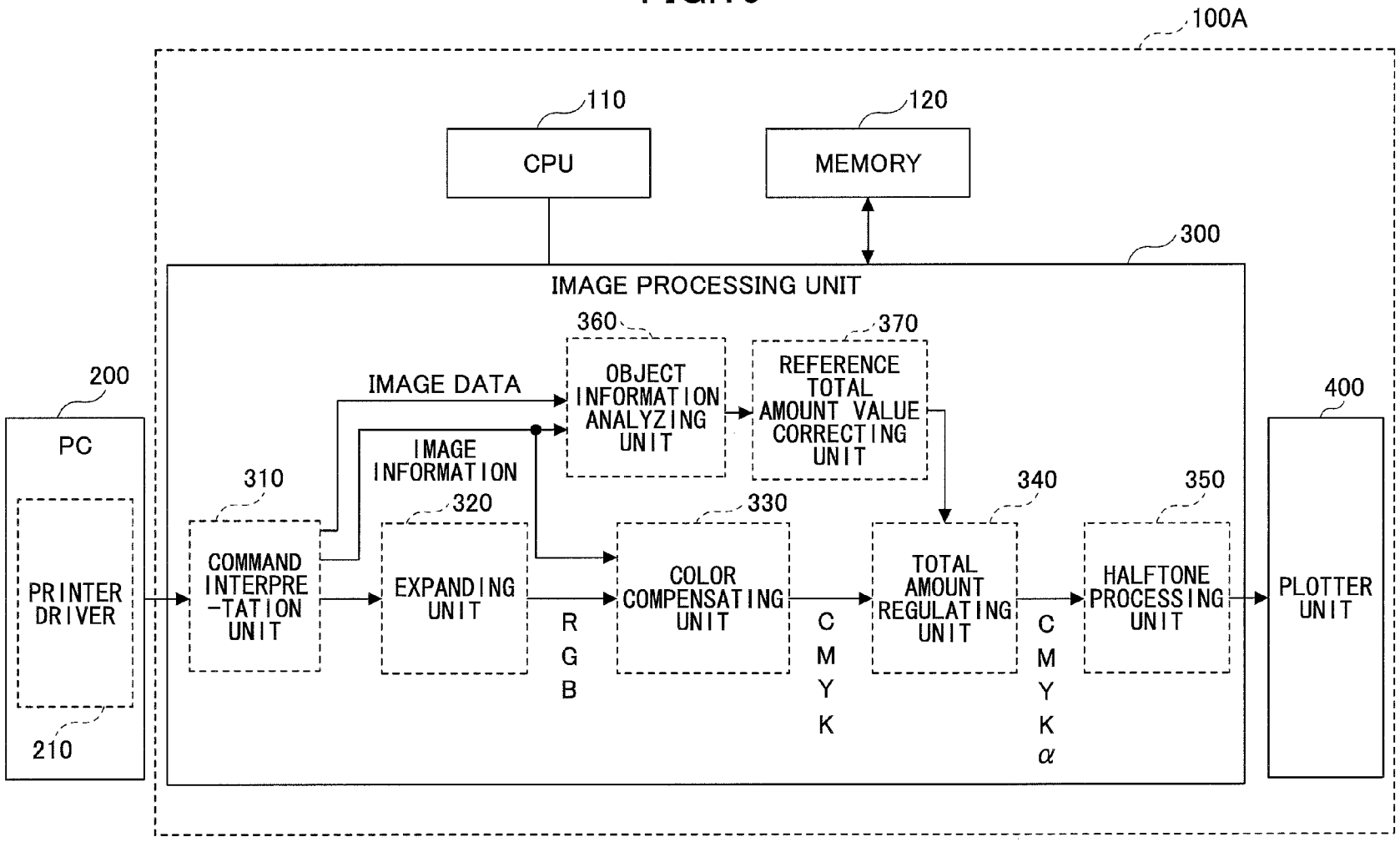
FIG. 10 is a diagram illustrating a functional configuration of an image forming apparatus according to a second embodiment.

FIG. 10 is a diagram illustrating a functional configuration of the image forming apparatus 100A according to the second embodiment. The image forming apparatus 100A according to the second embodiment includes a reference total amount value correcting unit 370, in addition to each component included in the image forming apparatus 100 of the first embodiment.

For example, when the reference total amount value setting unit 363 included in the object information analyzing unit 360 sets the plural reference total amount values αBases, the reference total amount value correcting unit 370 of the second embodiment derives a single reference total amount value from the plural reference total amount values αBases through logical operations, and passes the single reference total amount value to the total amount regulating unit 340.

Here, as the case in which the plural reference total amount values αBases are set, for example, a case in which plural human faces are recognized from the image data and other objects recognized as photographic subjects can be considered.

Figure 11:
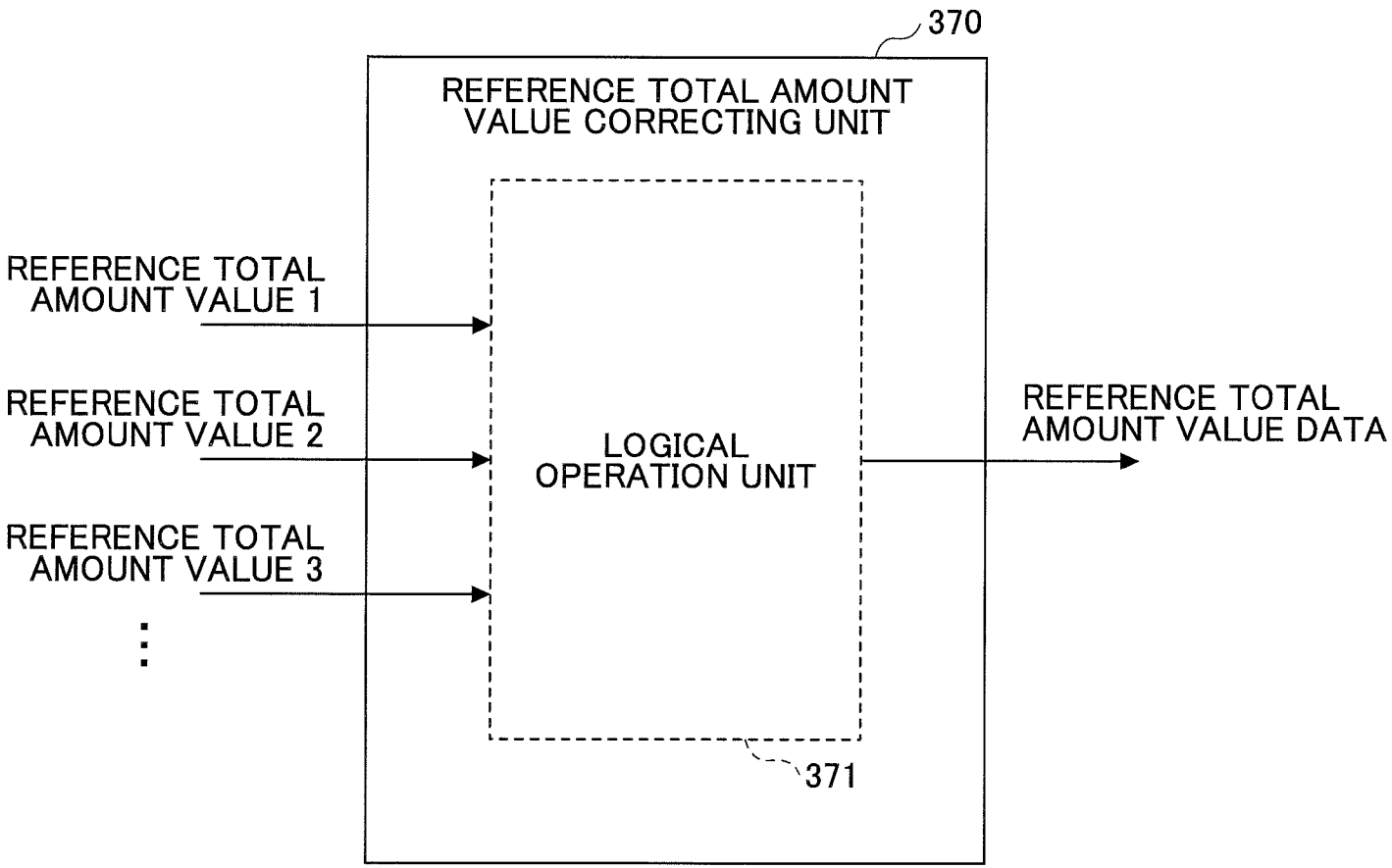
FIG. 11 is a diagram illustrating a reference total amount value correcting unit of the second embodiment.

FIG. 11 is a diagram illustrating the reference total amount value correcting unit 370 of the second embodiment. The reference total amount value correcting unit 370 of the second embodiment includes a logical operation unit 371.

When the plural reference total amount values αBases are set at the object information analyzing unit 360, the plural reference total amount values αBases are input to the logical operation unit 371. Then the logical operation unit 371 derives the single reference total amount value from the plural reference total amount values αBases through the logical operations.

Incidentally, when the single reference total amount value αBase is input to the reference total amount value correcting unit 370 of the second embodiment, it outputs the single reference total amount value αBase, which has been input, without any change.

The first embodiment and the second embodiment are explained above. However, the first embodiment and the second embodiment are not limited to the above descriptions.

The present invention is not limited to the specifically disclosed embodiments, and variations and modifications may be made without departing from the scope of the present invention.

The present application is based on Japanese Priority Application No. 2010-287196, filed on Dec. 24, 2010, the entire contents of which are hereby incorporated herein by reference.

What is claimed is:

1. An image forming apparatus that applies clear toner to an image to be formed based on image data being input and image information regarding the image data when forming the image, the image forming apparatus comprising:

a subject detection unit configured to detect a subject included in the image data based on the image information, the subject including plural pixels; and a setting unit configured to set a first maximum value for amounts of the clear toner, each amount being an amount of the clear toner to be applied to a corresponding pixel included in the subject, based on a detection result of the subject, wherein, upon the subject detection unit detecting plural subjects from the image data, the setting unit is configured to set the first maximum value based on a spacing of the plural subjects.

2. The image forming apparatus according to claim 1, wherein the setting unit is configured to set a greater value for the first maximum value as the spacing of the plural subjects decreases.

3. An image forming apparatus that applies clear toner to an image to be formed based on image data being input and image information regarding the image data when forming the image, the image forming apparatus comprising:

a subject detection unit configured to detect a subject included in the image data based on the image information, the subject including plural pixels; and a setting unit configured to set a first maximum value for amounts of the clear toner, each amount being an amount of the clear toner to be applied to a corresponding pixel included in the subject, based on a detection result of the subject, wherein the setting unit is configured to set the first maximum value by referring to the table.

4. The image forming apparatus according to claim 3, wherein, when the subject detection unit is configured to detect the subject from the image data, the setting unit sets the first maximum value based on a brightness difference between a brightness of the subject and a brightness of a surrounding area of the subject.

5. The image forming apparatus according to claim 4, wherein the setting unit is configured to set a greater value for the first maximum value as the brightness difference increases.

6. The image forming apparatus according to claim 5, further comprising:

a storage unit configured to store a table in which plural types of brightness differences between the brightness of the subject and the brightness of the surrounding area of the subject are associated with corresponding candidate values for the first maximum value, wherein the setting unit is configured to set the first maximum value by referring to the table.

7. The image forming apparatus according to claim 6, wherein the first maximum value is less than a second maximum value, the second maximum value being the greatest value among total values, wherein each total value is a sum of an amount of a cyan toner, an amount of a magenta toner, an amount of a yellow toner, and an amount of a black toner to be applied to one of the corresponding pixels included in the subject.

8. A method of forming an image using an image forming apparatus, the image forming apparatus applying clear toner to an image to be formed based on image data being input and image information regarding the image data when forming the image, the method comprising:

detecting a subject included in the image data based on the image information, the subject including plural pixels; and setting a first maximum value for amounts of the clear toner, each amount being an amount of the clear toner to be applied to a corresponding pixel included in the subject, based on a detection result of the subject, wherein, if plural subjects from the image data are detected, the setting of the first maximum value is based on a spacing of the plural subjects.

9. A non-transitory recording medium storing a program thereon which causes an image forming apparatus, the image forming apparatus applying clear toner to an image to be formed based on image data being input and image information regarding the image data when forming the image, to perform an image forming process, the image forming process comprising:

detecting a subject included in the image data based on the image information, the subject including plural pixels; and setting a first maximum value for amounts of the clear toner, each amount being an amount of the clear toner to be applied to a corresponding pixel included in the subject, based on a detection result of the subject, wherein, if plural subjects from the image data are detected, the setting of the first maximum value is based on a spacing of the plural subjects.

10. The image forming apparatus of claim 1, wherein, when the detection unit detects the subject from the image data, the setting unit is configured to set the first maximum value based on a brightness difference between a brightness of the subject and a brightness of a surrounding area of the subject.

11. The image forming apparatus according to claim 10, wherein the setting unit is configured to set a greater value for the first maximum value as the brightness difference increases.

12. The image forming apparatus according to claim 1, further comprising:

a storage unit configured to store a table in which plural types of brightness differences between the brightness of the subject and the brightness of the surrounding area of the subject are associated with corresponding candidate values for the first maximum value, wherein the setting unit is configured to set the first maximum value by referring to the table.

* * * * *